US006347412B1

(12) United States Patent
Dorman

(10) Patent No.: US 6,347,412 B1
(45) Date of Patent: Feb. 19, 2002

(54) SOUND REFLECTOR FOR A BICYCLIST

(76) Inventor: Mark Dorman, 29669 Fox Hollow Rd., Eugene, OR (US) 97405

( * ) Notice: Subject to any disclaimer, the term of this patent is extended or adjusted under 35 U.S.C. 154(b) by 0 days.

(21) Appl. No.: 09/694,520

(22) Filed: Oct. 23, 2000

(51) Int. Cl.[7] ..... A42B 1/08
(52) U.S. Cl. ..... 2/423; 2/209
(58) Field of Search ..... 2/423, 425, 422, 2/209; 181/129, 133, 136

(56) References Cited

U.S. PATENT DOCUMENTS

| | | | | | |
|---|---|---|---|---|---|
| 830,439 | A | * | 9/1906 | James | 2/423 |
| 2,140,630 | A | * | 12/1938 | Illguth | 2/423 |
| 4,997,056 | A | * | 3/1991 | Riley | 181/136 |
| 5,044,014 | A | * | 9/1991 | Cornale et al. | 2/209 |
| 5,323,493 | A | * | 6/1994 | Ogiba | 2/422 |
| 5,477,564 | A | * | 12/1995 | Tichy | 2/423 |
| 5,691,514 | A | * | 11/1997 | Landis | 181/129 |
| 5,691,515 | A | * | 11/1997 | Landis | 181/129 |
| 5,696,356 | A | * | 12/1997 | Dudley et al. | 181/136 |
| 6,029,282 | A | * | 2/2000 | Buschman | 2/422 |
| 6,153,128 | A | * | 11/2000 | Lightle et al. | 264/1.9 |

FOREIGN PATENT DOCUMENTS

| | | | | |
|---|---|---|---|---|
| DE | 912921 | * | 6/1954 | 2/209 |
| IT | 479645 | * | 4/1953 | 2/209 |

* cited by examiner

*Primary Examiner*—Rodney M. Lindsey
(74) *Attorney, Agent, or Firm*—Spencer Fane Britt & Browne LLP

(57) ABSTRACT

An apparatus is provided for diverting sound from a direction generally rearward of a user towards the user's ears. The apparatus includes a sound reflector which can be worn by the user directly or connected to a separate mount such as a helmet. A connection between the sound reflector and the helmet may be fixed or adjustable. An adjustable connection may be removable or permanent. When a helmet mount is used, the apparatus can include a splitter positioned between two sound reflectors. The splitter directs sound to each of the two sound reflectors. The addition of buffer pads aid the sound reflectors in deflecting air around the user's ears to reduce wind noise and increase the user's ability to hear sounds originating from the rearward direction.

9 Claims, 2 Drawing Sheets

20
41
40
10

20
45
40
41
45
10

45
45
10
10

55
50
60
56
10

20
50
60
10

17
20
18
10
18
10

SOUND REFLECTOR FOR A BICYCLIST

FIELD OF THE INVENTION

The present invention relates to a safety device to be worn by a user such as a bicyclist. The invention aids its user in detecting a vehicle approaching from the rear of the user without having to turn around and look.

BACKGROUND OF THE INVENTION

Many safety devices for the popular sport of bicycling have been developed to protect riders from injury. Reflective devices can be worn by bicyclists or mounted to the bicycle to increase rider visibility. Additionally, bicyclists can wear protective clothing and/or helmets to reduce potential injury. Rear view mirrors can be mounted to the bicycle to aid bicyclists in identifying approaching vehicles. However, rear view mirrors have not been popular among bicyclists for several reasons: mirrors can be easily knocked out of alignment such that a rider cannot adequately observe vehicles approaching from the rear; more importantly, rear view mirrors require an active effort by the rider to look at the mirror to determine if a vehicle is approaching. Until the development of the present invention, no safety device has been introduced to aid a rider in passively detecting a vehicle approaching from the rear.

SUMMARY OF THE INVENTION

An object of the present invention is to aid a rider of a bicycle in passively detecting a vehicle approaching from the rear of the rider. To achieve this object of the present invention, sound reflectors are positioned on the left and right sides of a helmet near the user's ears. The sound reflectors are designed to divert sound from a direction generally rearward of the rider and towards the rider's ears.

The sound reflectors may be attached to an existing helmet through either a permanent or a removable connection. A removable connection allows adjustment of the sound reflectors through substitution of sound reflectors of various shapes and sizes. Sound reflectors of various shapes and sizes provide a variety of sound gathering and amplification effects. Additionally, a removable connection allows a user to adjust the position of the sound reflectors. A permanent connection between the sound reflectors and the helmet may also be adjustable to allow the user to customize the position and orientation of the sound reflectors.

In an alternate embodiment a splitter can be positioned between the sound reflectors to increase the sound gathering area of the sound reflectors and to direct sound towards each of the sound reflectors. Additionally, a light reflector can be included on the splitter to aid in rider visibility.

Another object of the present invention is to reduce the noise of buffeting wind over a user's face and ears caused by the user's forward motion. Such noise curtails the user's ability to hear approaching vehicles. This object is achieved by positioning the sound reflectors near a user's face towards the front of the user's ears. A curved outer surface of each sound reflector directs airflow around the user's ears, thus reducing the accompanying noise. This advantage of the present invention is optimized by minimizing any gaps that would allow air to flow towards the user's ears. Gaps between the sound reflectors and the helmet are minimized by forming the sound reflectors and the helmet as an integral unit. Gaps between the user's face and the sound reflectors may be minimized by the inclusion of buffer pads between the edges of the reflectors and the user's cheeks.

The foregoing and other objects are intended to be illustrative of the invention and are not meant in a limiting sense. Many possible embodiments of the invention may be made and will be readily evident upon a study of the following specification and accompanying drawings comprising a part thereof Various features and subcombinations of the invention may be employed without reference to other features and subcombinations. Other objects and advantages of this invention will become apparent from the following description taken in connection with the accompanying drawings, wherein is set forth by way of illustration and example, an embodiment of this invention.

DESCRIPTION OF THE DRAWINGS

Preferred embodiments of the invention, illustrative of the best modes in which the applicant has contemplated applying the principles, are set forth in the following description and are shown in the drawings and are particularly and distinctly pointed out and set forth in the appended claims.

DESCRIPTION OF THE PREFERRED EMBODIMENTS

Preferred embodiments of the present invention are hereinafter described with reference to the accompanying drawings.

Figure 1:
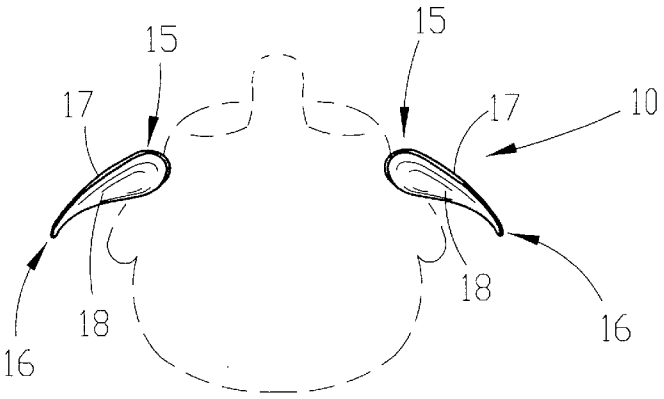
FIG. 1 is a top view showing the positioning of sound reflectors with respect to a rider's head.

Referring to FIG. 1, the positioning of sound reflectors 10 on a user's head is shown in phantom lines. FIG. 1 shows two sound reflectors 10, with each sound reflector 10 positioned on the user's head towards the front of each ear. Each sound reflector 10 has a first end 15 positioned near the user's face in front of the ear. From first end 15 sound reflector 10 extends outwardly from the user's face towards second end 16 of sound reflector 10. Sound reflector 10 is provided with outer surface 17 which is designed to allow air, from a direction in front of the user's head, to flow smoothly around the user's ear. This aerodynamic construction reduces the noise caused by buffeting wind. Still referring to FIG. 1, outer surface 17 of sound reflector 10 has a curved shape originating from first end 15 and extending towards second end 16. Second end 16 of sound reflector 10 is located at a position generally rearward of first end 15 with respect to the user's head. Inner surface 18 of reflector 10 has a generally parabolic shape with a focus near the user's ear. Inner surface 18 can be polished to optimize the reflective properties of sound reflector 10.

It will be obvious to one having ordinary skill in the art that outer surface 17 of sound reflector 10 can be altered in size, shape and position to achieve the desired flow of air across sound reflector 10 and to maximize the aesthetic appeal of sound reflector 10. Additionally, it will be obvious to one of ordinary skill in the art that the size and shape of inner surface 18 of sound reflector 10 can be varied to provide the desired sound gathering capability and amplification effects.

FIGS. 2 through 9 show preferred embodiments of the present invention wherein sound reflectors 10 are connected to bicycle helmet 20 which can be secured to a user's head. It will be obvious to one having ordinary skill in the art that the sound reflectors of the present invention can be worn by a user through a variety of mounts. For purposes of example only, sound reflectors 10 could be attached to a head band, a hat, or glasses frames which can then be worn by the user. Alternatively, a connection such as a clip could be utilized to secure sound reflectors 10 directly to the wearer without the use of a separate mount.

Figure 2:
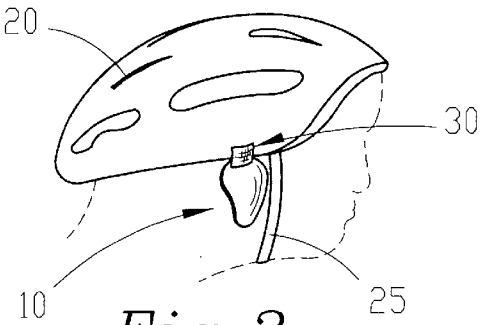
FIG. 2 is a side view of a helmet according to an embodiment of the present invention.

FIG. 2 shows an embodiment of the present invention in which sound reflectors 10 are connected to bicycle helmet 20. In FIG. 2, sound reflectors 10 are connected directly to the shell of bicycle helmet 20. Connections 30 between helmet 20 and sound reflectors 10 can be permanent or removable. By way of example, permanent connections 30 could be accomplished by gluing sound reflectors 10 to helmet 20. Alternatively, connections 30 between sound reflectors 10 and helmet 20 could be made removable by using a hook and pile material such as VELCRO. It will be obvious to one having ordinary skill in the art that numerous types of permanent and removable connections 30 can be substituted to achieve the desired object of the present invention.

Figure 3:
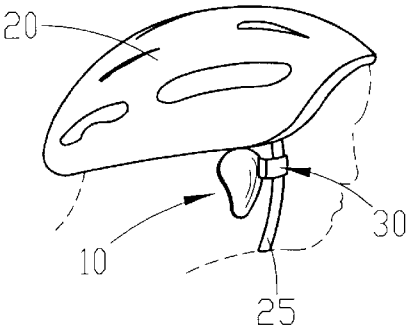
FIG. 3 is a side view of a helmet according to another embodiment of the present invention.

FIG. 3 shows a variation of the embodiment of in FIG. 2 in which connections 30 of sound reflectors 10 are located on chin strap 25 that is connected to helmet 20.

Figure 4:
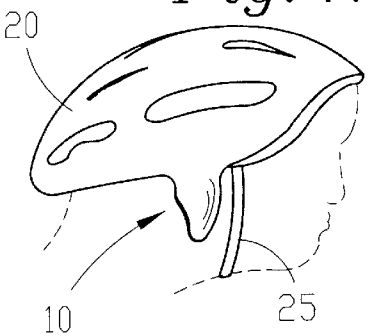
FIG. 4 is a side view of a helmet according to another embodiment of the present invention.
Figures 6, 7, 8, 9, 10, 11:
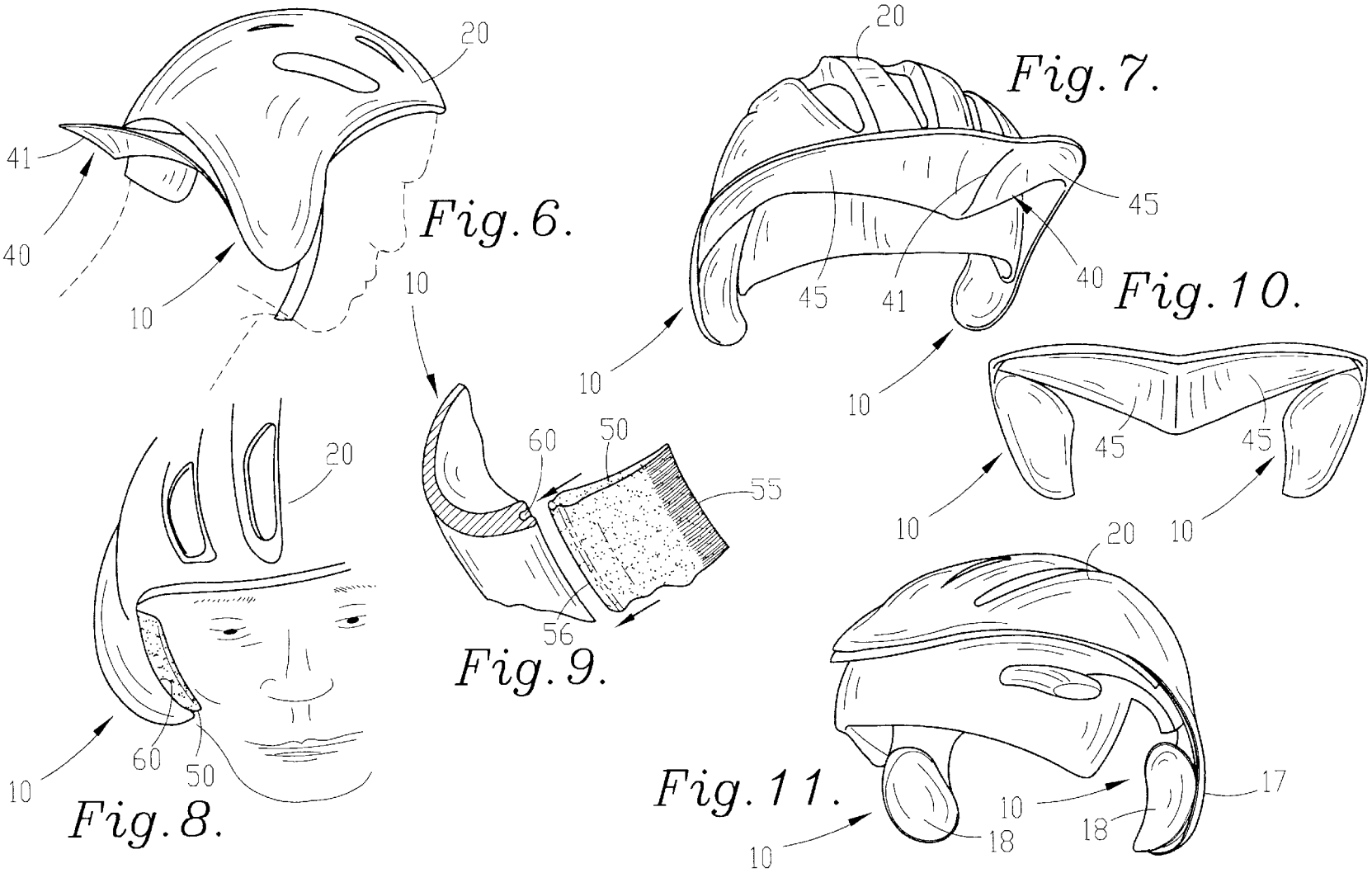
FIG. 6 is a side view of a helmet according to another embodiment of the present invention.
FIG. 7 is a rear perspective view of the helmet shown in FIG. 6.
FIG. 8 is a front view of a helmet of the present invention worn by a rider including a wind buffering pad.
FIG. 9 is a detailed view showing the connection between the helmet and the buffering pad shown in FIG. 8.
FIG. 10 is a detailed rear view of the splitter of FIGS. 6 and 7.
FIG. 11 is a detailed rear perspective view of the helmet of FIG. 4, showing adjustable inner surfaces for sound reflectors.

FIGS. 4 and 11 show another preferred embodiment of the present invention in which sound reflectors 10 are integrally molded with helmet 20. Inner surfaces 18 of sound reflectors 10 may be an integral part of the helmet and sound reflector combination of FIG. 4. Alternatively, FIG. 11 shows outer surfaces 17 of sound reflectors 10 integrally molded with helmet 20 while at the same time inner surfaces 18 of sound reflectors 10 are adjustably connected to the outer surfaces. As discussed in previous embodiments, adjustable connections 30 can be permanent or removable. A ball and socket type connection can be utilized as a permanent adjustable connection. A removable adjustable connection can be obtained through the use of hook and pile such as VELCRO. Such a removable connection would permit a user to substitute sound reflectors of varying sizes and shapes to achieve a desired sound gathering and amplification effect.

Figure 5:
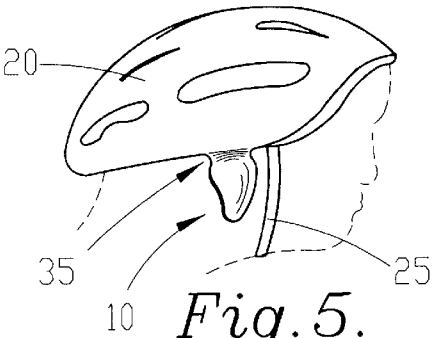
FIG. 5 is a side view of a helmet according to another embodiment of the present invention.

FIG. 5 another preferred embodiment of the present invention in which sound reflectors 10 are attached to helmet 20 through bendably adjustable connections 35. Adjustable connections 35 can be achieved by using a malleable material such as metal or plastic. The properties of the material selected for adjustable connections 35 should be such that adjustable connections 35 are capable of being bent by the user to set each sound reflector 10 in a desired position. Once each adjustable connection 35 has been bent by a user to position each sound reflector 10, the properties of the material selected for adjustable connection 35 should be such that adjustable connection 35 supports sound reflector 10 in the desired position.

FIGS. 6, 7 and 10 show another embodiment of the present invention that includes splitter 40 positioned between sound reflectors 10. Sound reflectors 10 are integrally molded with a left and right side of helmet 20; however, sound reflectors 10 may be separable from helmet 20. Splitter 40 is positioned between sound reflectors 10 and tapers outwardly from sound reflectors 10 in a direction rearward of helmet 20 to a splitter rear end section 41. In FIG. 7 splitter 40 comprises passages 45 which divert sound from splitter rear end section 41 toward sound reflectors 10. Splitter 40 and sound reflectors 10 may be molded as a single integral unit or sound reflectors 10 may be separable from the splitter. Splitter 40 may be molded as an integral unit with the shell of helmet 20 using a material such as Lexan. Alternatively, splitter 40 may be constructed separately from the shell of helmet 20 out of an entirely different material such as carbon fiber to provide a "high tech" appearance. Additionally, splitter 40 could include a light reflective surface or light reflective strands could be woven into the material of the splitter to increase the visibility of the helmet under night time conditions.

FIGS. 8 and 9 show the use of buffer pads 50 to deflect air away from the user's ears and to provide a more comfortable fit of sound reflectors 10 and helmet 20. Buffer pads 50 can be included in any of the above-described embodiments. FIG. 8 shows buffer pad 50 positioned between the first end 15 of each sound reflector 10 and the user's cheek. Each buffer pad 50 contacts the user's cheek along pad edge 55. FIG. 9 shows channel 60 located along an edge of first end 15 of each sound reflector 10. Channel edge 56 of each buffer pad 50 fits into channel 60 of each sound reflector 10 to allow buffer pads 50 to be removably attached to sound reflectors 10. Buffer pads 50 may be made of a soft neoprene or similar material. Buffer pads 50 are made removable from the sound reflector to enable a user to substitute buffer pads 50 of varying sizes to achieve a desired fit. The use of removable buffer pads enables a limited number of helmet sizes to fit a significant number of head sizes. Additionally, buffer pads 50 provide a seal between the user's cheeks and sound reflectors 10 which aid in streamlining the flow of air originating from the front of a rider and directed smoothly around the rider's ears by the sound reflectors 10. This reduces the amount of noise caused by buffeting wind on a rider's face and increases the rider's ability to detect vehicles approaching from the rear.

In the foregoing description certain terms have been used for brevity, clearness and understanding; but no unnecessary limitations are to be implied therefrom beyond the requirements of the prior art, because such terms are used for descriptive purposes and are intended to be broadly construed. Moreover, the description and illustration of the inventions is by way of example, and the scope of the inventions is not limited to the exact details shown or described.

Certain changes may be made in embodying the above invention, and in the construction thereof, without departing from the spirit and scope of the invention. It is intended that all matter contained in the above description and shown in the accompanying drawings shall be interpreted as illustrative and not meant in a limiting sense.

Having now described the features, discoveries and principles of the invention, the manner in which the inventive sound reflector is constructed and used, the characteristics of the construction, and advantageous, new and useful results obtained; the new and useful structures, devices, elements, arrangements, parts and combinations, are set forth in the appended claims.

It is also to be understood that the following claims are intended to cover all of the generic and specific features of the invention herein described, and all statements of the scope of the invention which, as a matter of language, might be said to fall therebetween.

I claim:

1. An apparatus for diverting sound from a direction generally rearward of a user towards at least one of the user's ears, said apparatus comprising:

at least one sound reflector; and an adjustable connection adapted to secure said at least one sound reflector to the user's head, wherein said connection comprises a malleable material.

2. The apparatus of claim 1 further comprising:

a buffer pad adapted to be placed between said at least one sound reflector and the user's head to deflect air and provide a comfortable fit.

3. The apparatus of claim 1 wherein said at least one sound reflector and said connection are an integral unit.

4. The apparatus of claim 3 wherein said connection comprises a helmet.

5. The apparatus of claim 1 wherein said connection attaches said at least one sound reflector to a helmet that can then be secured to the user's head.

6. The apparatus of claim 1 comprising:

two sound reflectors wherein one sound reflector directs sound to a first ear of the user, and a second sound reflector directs sound to a second ear of the user.

7. The apparatus of claim 6 further comprising:

a splitter positioned between said two sound reflectors to direct sound coming from a direction generally rearward of the user to said sound reflectors.

8. The apparatus of claim 7 further comprising:

a light reflector on said splitter.

9. The apparatus of claim 7 having an outer shell, the outer shell having an exterior surface and an interior surface;

said first and second sound reflectors being integrally molded with the outer shell thereby directing sound from the exterior surface towards the interior surface.

* * * * *